United States Patent [19]

Kawashima et al.

[11] Patent Number: 4,658,795

[45] Date of Patent: Apr. 21, 1987

[54] GASOLINE VAPOR CAPTURE AND COMBUSTION SYSTEM

[75] Inventors: Kenji Kawashima, Kakegawa; Katsuaki Asano, Iwata; Osamu Takii, Hamamatsu, all of Japan

[73] Assignee: Yamaha Hatsukoki Kabushiki Kaisa, Iwata, Japan

[21] Appl. No.: 745,689

[22] Filed: Jun. 17, 1985

Related U.S. Application Data

[63] Continuation of Ser. No. 428,132, Sep. 29, 1982, abandoned.

[30] Foreign Application Priority Data

Jul. 23, 1981 [JP] Japan ..... 56-114428

[51] Int. Cl.[4] ..... F02M 39/00

[52] U.S. Cl. ..... 123/519; 123/520; 261/DIG. 67

[58] Field of Search ..... 123/511, 520, 521, 518, 123/516, 514, 519; 261/DIG. 67, 44 C

[56] References Cited

U.S. PATENT DOCUMENTS

| | | | |
|---|---|---|---|
| 4,258,685 | 3/1981 | Arai | 261/DIG. 67 |
| 4,275,016 | 6/1981 | Morino | 123/519 |
| 4,283,356 | 8/1981 | Arai | 261/DIG. 67 |

FOREIGN PATENT DOCUMENTS

| | | | |
|---|---|---|---|
| 0040216 | 3/1977 | Japan | 123/519 |

*Primary Examiner*—Carl Stuart Miller

*Attorney, Agent, or Firm*—Fulwider, Patton, Rieber, Lee & Utecht

[57] ABSTRACT

Vapors normally arising within a standing gasoline tank are captured in a charcoal filled cannister. When the engine is running, air is drawn through the cannister thereby purging gasoline adsorbed on the charcoal within the cannister and delivering the purged gasoline vapors to the carburetor ultimately for combustion within the engine. Interference by the presence of such accumulated gasoline vapors in the carburetor, particularly during warm restarts and idling, can be avoided by preventing the injection of these gasoline vapors into the carburetor at the inappropriate times. Selective withholding of the purged gasoline vapors from a piston type carburetor, having a piston throttle valve disposed into and out of a venturi portion of the carburetor, is accomplished by injecting the gasoline vapors into the venturi portion through a purge port within the carburetor at a point such that the leading edge and outside surface of the piston type throttle valve closes and seals the port when the throttle valve is in a fully closed position. Thus, during idling and warm restarts, when the throttle valve is closed, no evaporated vapors are allowed to fill the venturi portion of the carburetor. Purging of the gasoline adsorbed on the charcoal within the cannister is accelerated by increasing the effective area of the purge port as the throttle valve is opened.

8 Claims, 5 Drawing Figures

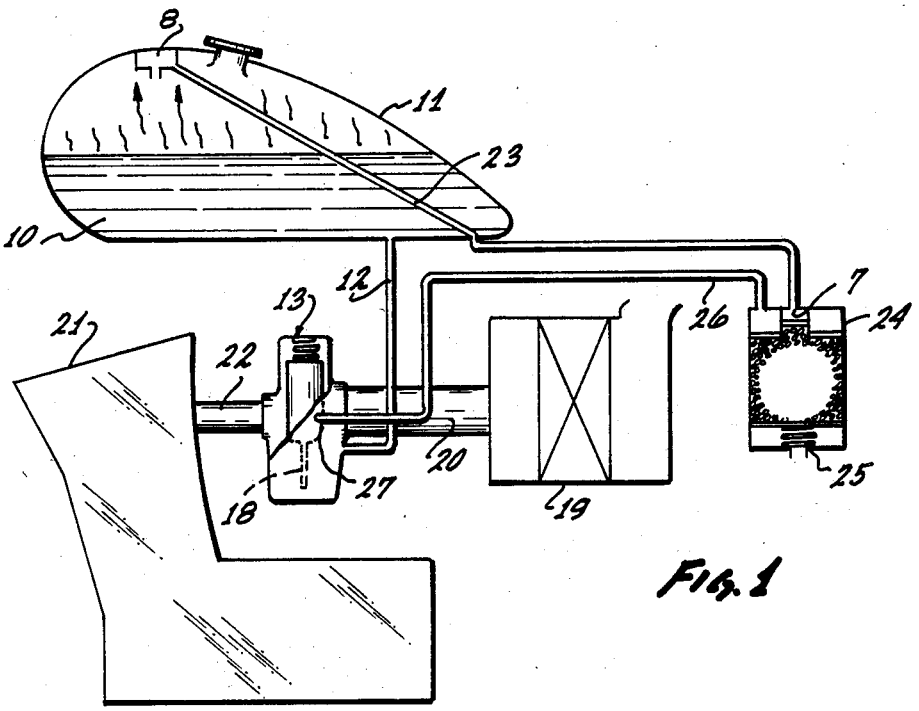
Fig. 1
Fig. 2
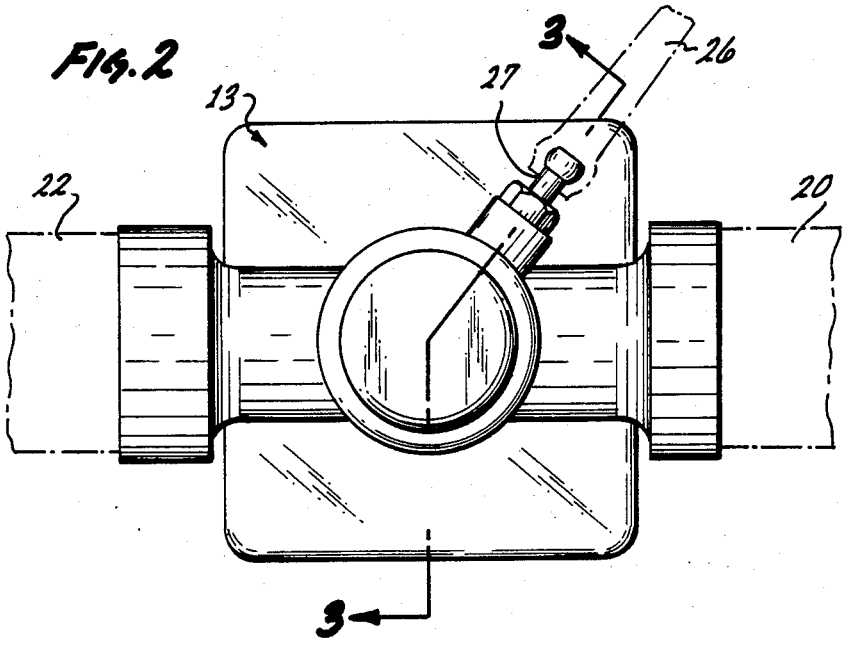

GASOLINE VAPOR CAPTURE AND COMBUSTION SYSTEM

This is a continuation of co-pending application Ser. No. 06/428,132 filed on 9/29/82 now abandoned.

BACKGROUND OF THE INVENTION

1. Field of the Invention

The present invention relates to the field of the capture and disposal of evaporated, stored liquid fuels. In particular the invention relates to a means for burning gasoline vapors in an internal combustion engine, which vapors originate from storage of the gasoline in a tank.

2. Description of the Prior Art

Gasoline vapors are thermally generated in a vehicle fuel tank under normal conditions. Vapor ladened air is normally expelled from the fuel tank by normal thermal heating and expansion. The evaporated gasoline is collected in the tank and directed to the charcoal filled cannister. The evaporated gasoline is then adsorbed on the activated surface of the charcoal, and the purged air is then discharged to the atmosphere. The gasoline vapors, which are adsorbed on the charcoal within the cannister are then reutilized within an associated internal combustion engine.

However, when the engine is operating the gasoline vapors which have been adsorbed by the activated charcoal are entrained and carried by ambient air flowing into the cannister and are carried through a purge passage into the intake manifold of the associated internal combustion engine. Thus, the adsorbed gasoline vapors are ultimately utilized and supplied to the engine for combustion.

In the prior art gasoline vapor capture and combustion systems described above, the purge passage from the cannister communicates with the intake manifold of the carburetor at a point downstream from the air cleaner and upstream to the carburetor. Therefore, when the activated charcoal in the cannister is saturated and the engine is stopped, newly created gasoline vapors flowing into the cannister, are not adsorbed by the charcoal, but flow through the purge passage into the intake manifold of the carburetor. The intake manifold is thus filled with gasoline vapors which the cannister has failed to adsorb. As a result, in such prior art gasoline vapor capture and combustion systems, the gasoline vapors either completely fill the intake manifold when the engine is stopped or flow into the intake manifold through the purge passage of the charcoal cannister during start-up or during the idling operation of the engine. At these times, the presence of these vapors substantially infer with restarting the engine after the engine has reached or approached operating temperatures. In addition to substantially decreasing the ability to perform a warm restart of the engine, the presence of these nonadsorbed gasoline vapors during the idling operation of the engine causes the air-to-fuel ratio to fluctuate erratically, thereby causing the idling operation of the engine to become very unstable.

What is needed is a solution which provides a gasoline vapor capture and combustion system which prevents the emission of gasoline vapors into the atmosphere and yet burns the captured evaporated gasoline without inferring with or causing the engine operation to become unstable, particularly in warm restarts or during idling.

BRIEF SUMMARY OF THE INVENTION

The present invention is a gasoline vapor capture and combustion system comprising an activated charcoal cannister for adsorbing the gasoline vapors which arise during normal operation from a fuel tank included in the system. The system includes a piston type carburetor which has a venturi portion into which a piston type, throttle valve is disposed. The gasoline vapor capture and combustion system is characterized by a purge passage communicating the venturi portion of the carburetor with the charcoal cannister. The point of communication of the purge passage with venturi portion of the carburetor is at and above the leading edge of the output side of the throttle valve when the throttle valve is configured in its fully closed position. By reason of this combination of elements, the throttle valve can be held in its fully closed position within the carburetor while the engine is stopped, started or during idling, thereby closing the purge passage and preventing interference from the captured gasoline vapors.

The present invention and its various embodiments are better described in connection with the following Figures, wherein like elements are referenced by like numerals, in view of the Detailed Description of the Preferred Embodiments.

BRIEF DESCRIPTION OF THE DRAWINGS

FIG. 1 is a schematic diagram showing one embodiment of a gasoline vapor capture and combustion system devised according to the present invention.

FIG. 2 is a top plan view in enlarges scale showing the carburetor of FIG. 1.

DETAILED DESCRIPTION OF THE PREFERRED EMBODIMENTS

FIG. 1 is a diagrammatic view showing a gasoline vapor capture and combustion system devised according to the present invention as particularly illustrated in a system used within a motorcycle. However, it must be understood that the gasoline vapor capture and combustion system of the present invention could be used in any type of vehicle and may be used in other types of internal combustion systems other than gasoline systems. First, the general environment of the invention will be described, followed by a generalized description of the invention, and then shall be followed by specific descriptions in the context of the three embodiments shown in FIGS. 3–5.

Figure 3:
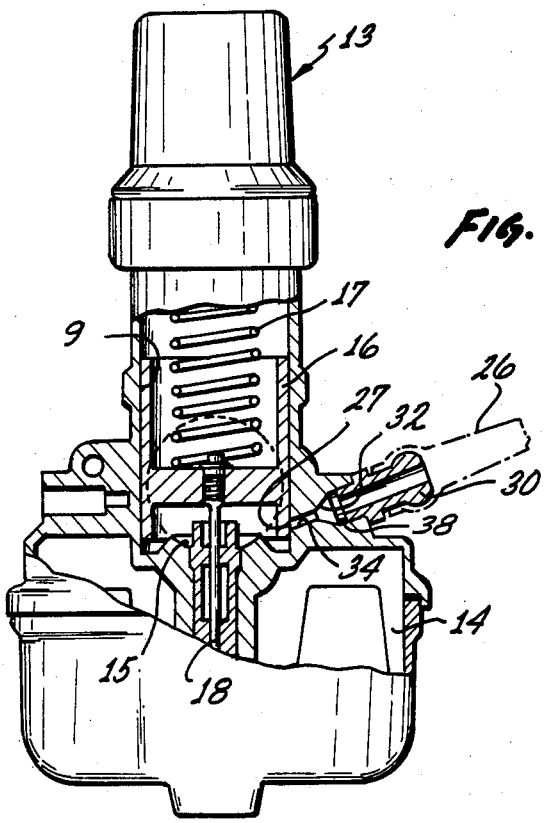
FIG. 3 is a partially cut-away sectional view of the carburetor of FIG. 2 taken through line 3—3 of FIG. 2.
Figure 4:
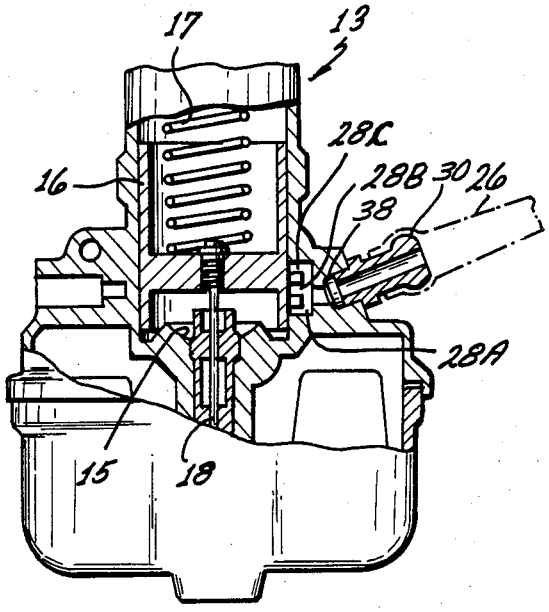
FIG. 4 is a partially cut-away sectional view in enlarged scale of a second embodiment of the carburetor of FIG. 1.
Figure 5:
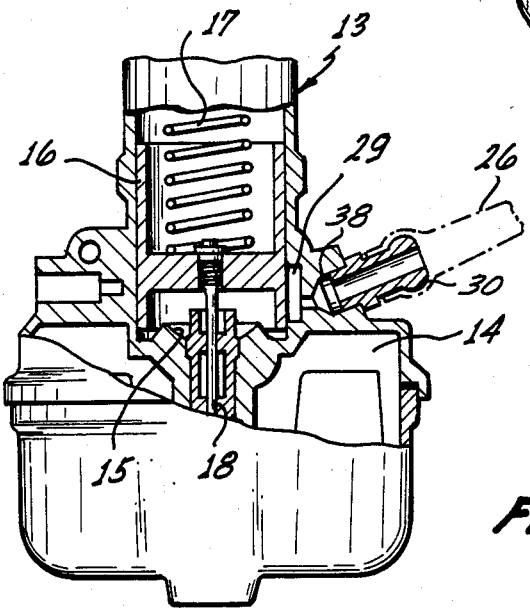
FIG. 5 is a partially cut-away sectional view in enlarged scale of a third embodiment of the carburetor of FIG. 1.

Referring now to FIG. 1, liquid gasoline fuel 10 stored within gasoline tank 11 is delivered to a carburetor 13 in a conventional manner by use of a fuel line 12 connected between tank 11 and float chamber 14 of carburetor 13, which float chamber 14 is partially illustrated in FIGS. 3–5.

In the illustrated embodiment, carburetor 13 is a piston type carburetor and is characterized by having a venturi portion 15, again best illustrated in FIGS. 3–5, in which a cylindrical throttle valve 16 is slidable in a vertical direction. The vertical disposition of throttle valve 16 within a corresponding cylindrical chamber within carburetor 13 is controlled by an adjustment wire (not shown) which positions throttle valve 16 against the biasing force of compression spring 17. Therefore, the effective volume of the venturi portion 15 of carburetor 13 can be adjusted by the positioning of throttle valve 16 within cylindrical bore 9 carburetor 13.

With continued reference to the embodiments of FIGS. 3–5, a needle 18 is disposed through and projects from the lower side of throttle valve 16. Needle 18 controls the variable clearance for a metering jet (not shown) to control the flow of fuel from float chamber 14 into venturi portion 15 of carburetor 13.

Returning now to FIG. 1, an intake manifold 20 communicates with venturi portion 15 of carburetor 13, the opposing end of manifold 20 being connected to a conventional air cleaner 19, diagrammatically illustrated in FIG. 1. The output of carburetor 13 is connected to a manifold 22 which in turn is appropriately connected to an engine 21, diagrammatically illustrated in FIG. 1 to supply the required air/fuel mixture from carburetor 13 to engine 21 in a conventional manner. When throttle valve 16 of carburetor 13 is opened, throttle valve 16 moves upwardly against the force of compression spring 17 to increase the effective volume of venturi portion 15 and to increase the clearance between needle 18 and the metering jet. As a result, more air is allowed to pass into carburetor 13 as venturi portion 15 is enlarged and more fuel admitted from float chamber 14. Thus, the volume of air/fuel mixture supplied to engine 21 is increased and engine output increased.

Due to normal thermal expansion, fuel 10 within tank 11 evaporates and collects in the upper portion of tank 11. Tank 11 is provided with a gasoline vapor suction port 8 at or near the highest point within gasoline tank 11. Gasoline vapor suction port 8 is communicated by means of a vacuum tube 23 with the intake port 7 of activated charcoal cannister 24. Cannister 24, diagrammatically shown in FIG. 1, includes an air vent 25. When the engine is not operating, gasoline ladened vapors from tank 11 diffuse through suction port 8, passage 23 and through inlet port 7 of cannister 24 where the gasoline vapors are adsorbed by the activated charcoal. The purged air is then vented to the outside atmosphere through air vent 25.

When the engine is running, ambient air is drawn through air vent 25 into cannister 24. Cannister 24 also includes a purge passage 26 which communicates the interior of cannister 24 with carburetor 13. Gasoline vapors adsorbed in the activated charcoal within cannister 24 are thus purged through passage 26 into carburetor 13. The coupling of passage 26, as described in greater detail in connection with the embodiments of FIGS. 3–5, is delivered to carburetor 13 at a point opposing the leading side or surface of throttle valve 16 when throttle valve 16 is fully closed. More specifically, when engine 21 is stopped, started or running idly, throttle valve 16 will normally be in its fully closed position. A purge valve opening 27 of purge passage 26, shown best in FIG. 3, is closed by the lower edge portion of throttle valve 16. As a result, gasoline vapors within cannister 24, even when the cannister is saturated with adsorbed gasoline, cannot flow through purge passage 26 into carburetor 13 when throttle valve 16 is closed. The leading edge of throttle valve 16 thus serves as a valve for the controlled injection of gasoline vapors into carburetor 13.

More specifically, as shown in FIG. 3, purge passage 26, shown in dotted outline, is coupled to a conventional fitting 30 which in turn is threaded into an inlet port 32 defined within the body of carburetor 13. Inlet port 32 includes a metering duct 34 which communicates with venturi portion 15 of the internal cylindrical chamber defined by bore 9 of carburetor 13. However, duct 34 is closed off by the adjacent leading edge 36 of throttle valve 16 when throttle valve 16 is fully closed as shown in the position illustrated in FIG. 3.

It can be noted that purge opening 27, defining the outlet port of duct 34, is positioned within carburetor 13 on the side of carburetor 13 adjoining the communication between carburetor 13 and air intake manifold 20 communicating with air cleaner 19. Therefore, during the startup of the engine, there is no effect upon fow in purge passage 26 by reason of the engine vacuum.

It is now possible to understand the overall operation of the present invention as implemented within the first embodiment of FIG. 3. When gasoline in fuel tank 11 is evaporated, the vapor pressure within fuel tank 11 is increased, causing the gasoline vapors to flow through gas vapor passage 23 into cannister 24. When engine 21 is stopped, gasoline vapors are then adsorbed by the activated charcoal so that the purged air is discharged through air vent 25 to the outside environment. Moreover, when the engine is stopped, and even if the activated charcoal within cannister 24 is totally saturated with adsorbed gasoline, newly evaporated gasoline flowing into cannister 24 may enter purge passage 26, but cannot flow into carburetor 13 because purge opening 27 of duct 34 is tightly shut off by the leading edge 36 of throttle valve 16.

When the engine is started, throttle valve 16 is still maintained within its fully closed position line vapors cannot flow through cannister 24 into carburetor 13. As a result, the air/fuel mixture does not become overly rich and the ability of engine 21 to warm restart is not degraded by the presence of gasoline vapors from the capture and combustion system.

When engine 21 enters normal operation with throttle valve 16 open, gasoline adsorbed within the activated charcoal in cannister 24 is carried by the flow of ambient air through air vent 25 into carburetor 13 through purge passage 26 and purge opening 27 to ultimately be burned within the combustion chambers of engine 21. At this time, the activated charcoal is cleansed by the flow of ambient air through cannister 24 so that cannister 24 is recharged and reactivated.

In the embodiment of FIG. 3, purge opening 27, communicating with purge passage 26 and cannister 24, is completely shut off by throttle valve 16 when starting and stopping the operation of the engine 21. Even where the activated charcoal in cannister 24 is saturated with adsorbed gasoline, gasoline vapors do not flow into carburetor 13 and are purged from cannister 24 into carburetor 13 only during normal operation of engine 21. As a result, the ability of engine 21 to perform warm restarts is uneffected and the designed air/fuel ratio during idling is similarly uneffected.

FIGS. 4 and 5 are partial sectional views of the carburetor illustrated in FIG. 1 showing second and third embodiments respectively of the present invention. Turning now to FIG. 4, the body of carburetor 13 in the second embodiment is formed with a plurality of purge openings 28*a*, 28*b* and 28*c*, each which are directed upwardly into venturi portion 15 of carburetor 13 and face the outer surface and leading edge 36 of throttle valve 16. Similarly, purge openings 28a–28c each communicate through an internal passage 38 defined within the body of carburetor 13 with fitting 30 and hence purge passage 26. As before, purge openings 28a–28c are each fully closed by the leading edge and side of throttle valve 16.

Turning now to the third embodiment illustrated in FIG. 5, the body of carburetor 13 is formed with a slotted purge opening 29 which is directed upwardly toward venturi portion 15 and which also faces the outside surface and leading edge 36 of throttle valve 16. In the same manner, purge opening 29 of the third embodiment is fully closed by leading edge 36 of throttle valve 16 when the throttle valve is in its fully closed position.

As in the case of the first embodiment of FIG. 3, the second and third embodiments of FIGS. 4 and 5 respectively have their respective purge openings fully closed when the engine is stopped or started. The effective area of the purge opening of the embodiments of FIGS. 4 and 5 are, however, increased either stepwise, in the case of the second embodiment, or continuously, in the case of the third embodiment, as the engine is brought into its normal operating state as the opening of throttle valve 16 is increased. Thus, the flow rate of gasoline vapors purged from cannister 24 into carburetor 13 is similarly increased. As a result, cannister 14 is purified or recharged so that the adsorbing action of cannister 24 can be maintained at a satisfactory level at all times. This allows the use of a cannister of smaller size and capacity than needed in the first embodiment of FIG. 3.

In the second and third embodiments, the larger the opening of throttle valve 16, the greater the volume of gasoline vapors which flow from cannister 24 into carburetor 13. However, this does not cause the operation of the engine or the carburetion state to become unstable, because there is a larger range of stable air/fuel ratios when the engine is running at a high load than at idling or starting.

It must be understood that many alterations amd modifications may be made by those having ordinary skill in the art without departing from the spirit and the scope of the present invention. The embodiments described above have been shown only for the purposes of clarity and illustration and must be taken as limiting the scope of the following claims.

We claim:

1. An improved fuel vapor capture and combustion system comprising:

a fuel tank including a fuel outlet;

a vapor suction port in the upper part of said tank for receipt of fuel vapors generated in said tank;

a cannister for purging fuel from fuel vapor collected in said suction port and including a vapor inlet, purge outlet, and an air vent for discharging air therefrom;

a vapor conduit connecting said suction port with said vapor inlet;

a carburetor including a fuel inlet, a fuel mixture outlet, and throttle valve means having start and stop positions;

a purge inlet, in said carburetor leading to the throat thereof and arranged and disposed to be closed by said throttle valve means in response to closure of said throttle valve and further operative upon the opening of said throttle valve means to open;

a fuel line connected between said fuel outlet and said fuel inlet; and a purge conduit connecting said vapor outlet of said cannister with said purge inlet of said purge valve means whereby fuel vapors collected in the upper portion of said fuel tank may, when said throttle valve is opened to open said purge valve, flow through said suction port to said vapor conduit, through said cannister and into said purge inlet of said carburetor and, further said vapors, when said throttle valve is closed causing closure of said purge inlet to block flow from said cannister through said purge conduit and into said purge inlet to the throat of said carburetor.

2. The system of claim 1 wherein said cannister further includes an air vent to admit ambient air into said cannister when gasoline vapors are drawn from said cannister into said carburetor, whereby said activated charcoal within said cannister is recharged.

3. An improved fuel vapor capture and combustion system according to claim 1 wherein:

said throttle valve has an idle position; and said purge valve means is operatively connected with said throttle valve to cause said purge valve means to be responsive to said idle position of said throttle valve means to close said purge valve means.

4. An improved fuel vapor capture and combustion system according to claim 1 that includes:

an air cleaner;

an air hose connected between said air cleaner and said carburetor to communicate air from said air cleaner to said carburetor; and wherein said purge valve means is operative upon closure of said throttle valve means to terminate communication from said purge conduit to said air hose.

5. An improved gasoline capture and combustion system according to claim 1 wherein:

said throttle valve means includes a cylindrical wall defining a piston chamber and a piston disposed in said chamber, said wall being formed with said purge inlet disposed therein in confronting relationship with said piston to be closed by said piston when said throttle valve means is in its closed position and to be cleared by said piston when said throttle valve means is in its open position.

6. An improved fuel vapor capture and combustion system according to claim 4 wherein:

said air hose is connected with said carburetor on the same side as said purge inlet.

7. An improved gasoline capture and combustion system according to claim 5 wherein:

said purge inlet is formed with port means elongated in the direction of travel of said piston and opening in confronting relationship with the side wall of said piston to be progressively closed thereby as said piston travels toward its closed position.

8. An improved gasoline capture and combustion system according to claim 7 wherein:

said port means is formed with discrete ports spaced apart in the direction of travel of said piston.

* * * * *